US005133513A

United States Patent [19]

Cassidy

[11] Patent Number: 5,133,513

[45] Date of Patent: Jul. 28, 1992

[54] STRANDER BOBBIN BRAKE BAND

[75] Inventor: Vincent T. Cassidy, Perry County, Ind.

[73] Assignee: Southwire Company, Carrollton, Ga.

[21] Appl. No.: 677,900

[22] Filed: Apr. 22, 1991

[51] Int. Cl.[5] ..... B65H 59/04

[52] U.S. Cl. ..... 242/156; 188/77 R; 188/251 A; 188/259

[58] Field of Search ..... 242/156, 156.1, 156.2, 242/75.4, 75.41, 75.42, 75.43, 75.44, 75.45, 75.46, 75.47, 155 R, 86.7, 99; 188/251 R, 251 A, 77 R, 249, 250 H, 259

[56] References Cited

U.S. PATENT DOCUMENTS

| | | | |
|---|---|---|---|
| 2,136,111 | 11/1938 | Laurent | 188/77 R |
| 3,117,737 | 1/1964 | Ball et al. | 242/156 X |
| 3,228,624 | 1/1966 | Brinkman | 242/156.2 X |
| 3,540,675 | 11/1970 | Goldsworthy | 242/156.2 |
| 3,575,267 | 4/1971 | Lauer, Jr. | 242/156 X |
| 3,684,062 | 8/1972 | Johnson | 188/251 R |
| 3,730,920 | 5/1973 | D'Alessandro | 188/251 A X |
| 3,912,191 | 10/1975 | Anderson et al. | 242/156.2 X |
| 3,920,136 | 11/1975 | Talbert | 242/75.41 X |
| 4,014,828 | 3/1977 | Thorpe | 188/251 R X |
| 4,134,558 | 1/1979 | Grillo | 242/75.4 X |
| 4,762,216 | 8/1988 | Pusatcioglu et al. | 188/251 A X |

FOREIGN PATENT DOCUMENTS

| | | | |
|---|---|---|---|
| 45759 | 2/1965 | Fed. Rep. of Germany | 242/156 |

*Primary Examiner*—Stanley N. Gilreath
*Attorney, Agent, or Firm*—James W. Wallis, Jr.; Stanley L. Tate; George C. Myers, Jr.

[57] ABSTRACT

A brake band for the bobbins used on a rigid frame wire strander. The brake band is a substantially non-porous polyester strip or band, preferably made of polyethylene terephthalate (PET). The band is provided with a longitudinal crease for keeping the band centered on the hub of the bobbin with which it is associated.

13 Claims, 1 Drawing Sheet

STRANDER BOBBIN BRAKE BAND

FIELD OF THE INVENTION

The invention relates to a breakage and wear resistant brake strap or band for bobbins used on a rigid frame wire strander.

BACKGROUND OF THE INVENTION

It is well known that rotatable bobbins or spools for windable materials require braking action to avoid free wheeling of the bobbins or spools and the resultant breakage of the windable material or breakouts of the wire during stranding of a wire. The emphasis on addressing these problems has been on providing self-adjusting or self-compensating brake assemblies.

For example, U.S. Pat. No. 2,166,243 to Elvin is directed to a bobbin having a brake strap fixedly attached at one end and attached to a tensioning weight at the other end. A bobbin is provided having a pair of flanges with a bushing extending coaxially from the exterior of one flange, with the bushing having an annular groove in which a brake band or tape is guided.

U.S. Pat. No. 2,419,808 to Wirth is directed to a wire tensioning device for coil winding machines having a brake band which is fixedly attached at one end and attached at the other end to a spring-loaded cammed tensioning lever. The brake band consists of a woven belt of linen, cotton or silk and the braking surface of the brake drum is provided with fine grooves.

U.S. Pat. No. 3,120,930 to Forman et al. is directed to a roller mounting and brake in which a brake band or strap is fixedly attached at one end to a cross bar and attached at the other end to a pivotal cross bar of a teeter frame, to effect tensioning. The brake strap is preferably of canvas or other suitable material.

U.S. Pat. No. 3,575,267 to Lauer, Jr. is directed to a self-compensating load responsive brake assembly in which an endless brake band is attached to a pivot arm with one end connected to a bearing support and the other end to a spring-biased bearing member. The pivot arm is adjustable by means of a toggle member. The brake band is formed of metal backed leather lining, but the lining alternatively may be a material such as an asbestos-type brake lining.

U.S. Pat. No. 3,912,191 to Anderson et al. is directed to a tape tensioning control assembly having a brake band which is tensioned by being attached at one end to a fixed arm and at the other end to a spring-biased pivotally mounted arm.

In one known conventional wire strander, wire bobbins mounted to the strander frame are prevented from free wheeling by a brake band comprising a rope made of strands of polyester or other plastic fibers. The rope is passed about a portion of the bobbin hub extending beyond a bobbin end flange and is tensioned by means of an adjustment screw mounted on the strander frame. A pair of S-hooks are typically used to connect the ends of the rope to the adjustment mechanism. The conventional brake apparatus is subject to several problems associated with the ropes used for the brake. Oil and dirt penetrate into the rope fibers and cause a jerking motion of the bobbin which, in turn, results in wire breakouts. Humidity and heat also cause tightening up of the rope and require periodic loosening of the tension adjustment.

From the foregoing, it should be apparent that heretofore little attention has been paid to material selection for the brake band material and for possible preferred brake band cross sections or for the interfacing of the brake band with the friction surface of the spool or bobbin hub. These shortcomings of the prior art device are addressed by the present invention.

SUMMARY OF THE INVENTION

According to the present invention, a non-porous polyester strap is used in place of the conventional plastic or polyester rope or other brake band materials described above thereby preventing build-up of oil and dirt on the brake element. The polyester strap is more dimensionally stable with changes in heat and humidity than the rope. The strap is preferably creased longitudinally along its centerline so as to provide a means for retaining the strap in place on the hub. The hub is preferably provided with a shallow circumferential groove or depression in which the crease is guided.

BRIEF DESCRIPTION OF THE DRAWINGS

With the foregoing and other advantages and features of the invention that will become hereinafter apparent, the nature of the invention may be more clearly understood by reference to the following detailed description of the invention, the appended claims and to the several views illustrated in the attached drawings, wherein:

DETAILED DESCRIPTION OF THE INVENTION

Figure 1:
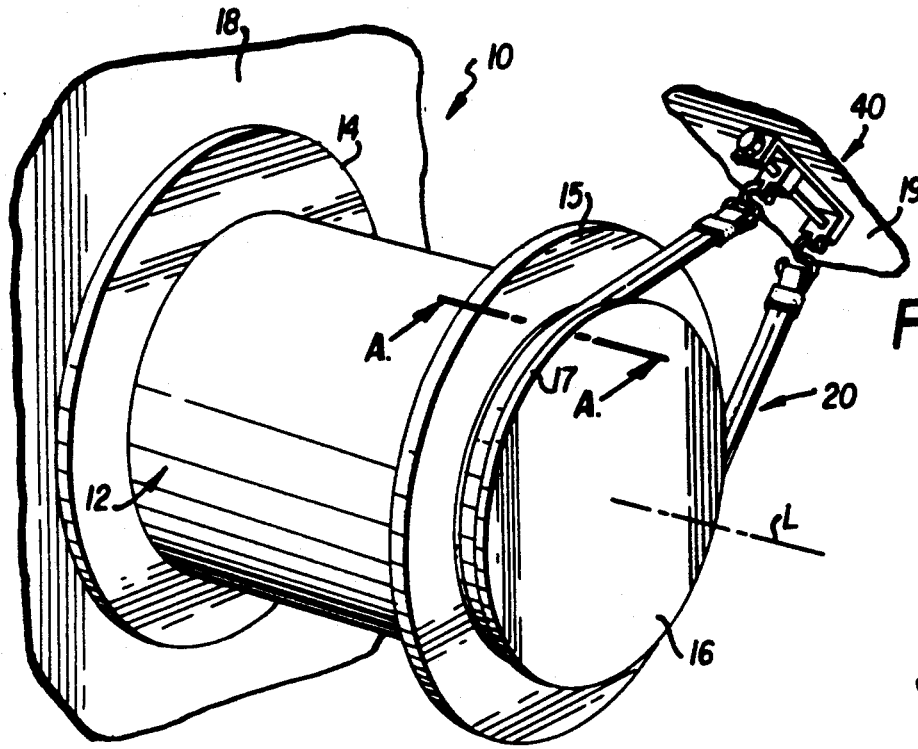
FIG. 1 is a perspective view of a bobbin engaged by a brake band of a preferred embodiment of the present invention.

Referring now to the drawings, there is illustrated in FIG. 1 a perspective view of a strander bobbin having a preferred embodiment of a brake band assembly of the invention, designated generally by the numeral 10. The bobbin or spool 12 is provided with rims 14, 15 and hub 16 with end flange 17 and is rotatably mounted to a strander frame 18 in a conventional manner. A brake band or strap, designated generally by reference numeral 20, is disposed on the circumferential surface 22 of hub 16 between rim 15 and end flange 17. Brake band 20 is tensioned by a conventional adjustable tensioning device 40 mounted to a portion of the strander frame 19.

Figure 2:
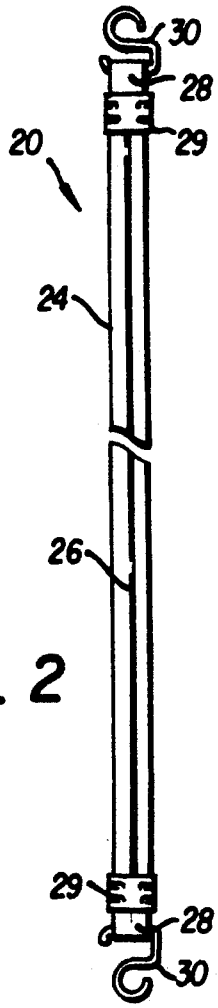
FIG. 2 is a plan view of a brake band of a preferred embodiment of the present invention.

Referring to FIG. 2, brake band 20 is formed of a flat, substantially non-porous strip 24 of material, preferably a polyester material, such as polyethylene terephthalate (PET), having preferred dimensions of 0.625 inch width and 0.025 inch thickness. One material that has been found particularly suitable for use as the brake band of the present invention is a PET strapping material available from Interlake Packaging, Oak Forest, Ill. under product code designation 196-5325.

A slight longitudinal crease or bend 26 is disposed along the longitudinal centerline of strip 24 for a purpose to be described hereinafter. Each end of the strip 24 is folded back upon itself to form a loop 28 which is secured by means of a crimped fitting 29 of the type used to secure strapping material together. To each loop 28 there is fitted an S-hook 30 which is used to secure the brake band 20 to the tensioning device 40.

Figure 3:
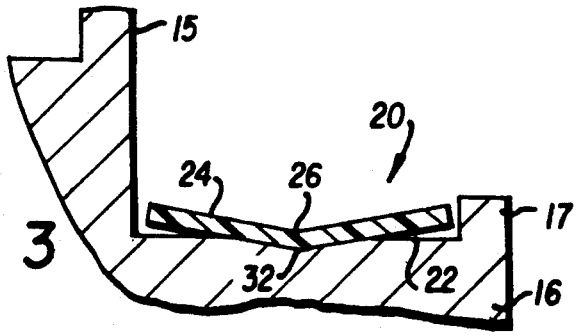
FIG. 3 is a partial cross-section taken through section A—A of FIG. 1 of a brake band of a preferred embodiment of the present invention as it engages a bobbin hub in an untensioned state.

As shown in FIG. 3, the creased brake band 20 is guided on the circumferential braking surface 22 of bobbin hub 16 between rim 15 and flange 17. The surface 22 is preferably provided with a shallow circumferential groove or depression 32 located approximately so as to guide and align the longitudinal crease 26 of brake band 20 in the center of the surface 22. Although as shown in FIG. 3 the brake band 20 is in its untensioned state, those skilled in the art will appreciate that when tension is applied to the brake band 20, it will engage the surface 22 and, to some extent, conform to the cross-sectional shape of surface 22.

Figure 4:
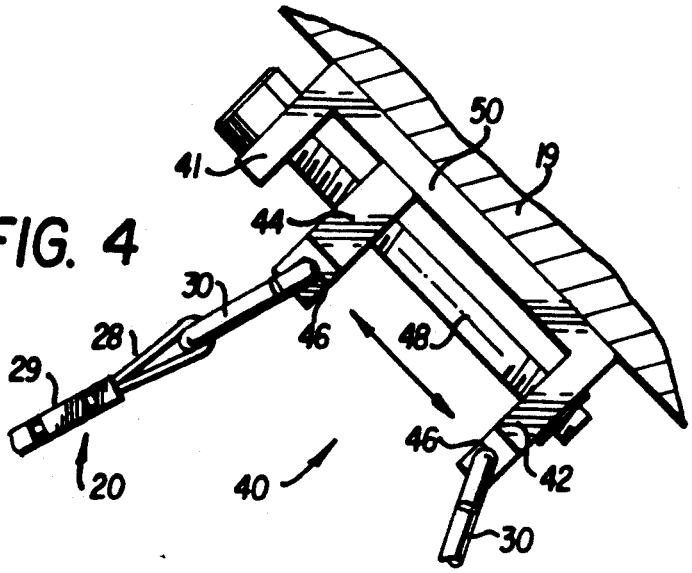
FIG. 4 is a fragmentary side elevation view of a brake band tensioning device of a preferred embodiment of the present invention.

FIG. 4 illustrates the operation of tensioning device 40, which comprises a bracket 50 secured to strander frame 19. Bracket 50 is provided with a pair of support arms 41, 42 for rotatably supporting a threaded bolt 48 between them. Support arm 42 comprises a stationary mounting block for one end of the brake band 20 and is provided with an eyelet 46 into which one of the S-hooks 30 is engaged. A movable mounting block 44 having a threaded bore is threaded onto bolt 48 between support arms 41, 42 such that rotation of bolt 48 will move mounting block 44 to any position between arms 41, 42. Mounting block 44 is also provided with an eyelet 46 into which the other S-hook 30 of brake band 20 is engaged. As will be apparent, rotation of threaded bolt 48 will vary the position of mounting block 44 between the arms 41, 42 and will thereby increase or decrease the tension in band 20 and the frictional force with which the band engages the surface 22 of hub 16.

In operation, bobbin 12 is rotated about its longitudinal axis L to pay out the wire thereon. During periods of acceleration and deceleration or irregular feed of the wire from the bobbin, brake band 20 serves to prevent free wheeling or overspeed of the bobbin 12 and thereby prevents breakage of the wire on the bobbin 12 and subsequent breakouts on the stranded wire. Because brake band 20 is made of a non-porous polyester strip, wear and breakage of the brake band is reduced and oil and dirt are unable to penetrate into the brake band. By providing a longitudinal crease 26 in brake band 20 and a shallow groove 32 in hub 16, brake band 20 remains substantially centered between the rim 15 and flange 17 of the bobbin 12.

It is contemplated that a polyester brake band and/or a polyester brake band having a longitudinal crease therein and aligned with a groove on a hub can be used on other prior art brake assemblies, including self-adjusting or self-compensating brake assemblies, as described above.

Although a certain preferred embodiment of the invention has been described herein, it will be apparent to those skilled in the art to which the invention pertains that variations and modifications of the described embodiment may be made without departing from the spirit and scope of the invention. Accordingly, it is intended that the invention be limited only to the extent required by the appended claims and the applicable rules of law.

What is claimed is:

1. A brake apparatus comprising;

a rotatable bobbin having a hub, said bobbin being adapted to accommodate a supply of wire;

a brake band engageable with said hub and comprising a substantially non-porous, flat polyester strap; and means connected to said brake band for holding said brake band engageable with said hub.

2. The brake apparatus according to claim 1, wherein said strap has a longitudinal dimension, and further comprising a crease formed along said longitudinal dimension.

3. The brake apparatus according to claim 1, wherein said strap has a longitudinal centerline, and a crease located substantially along the longitudinal centerline of said strap.

4. The brake apparatus according to claim 2, wherein said hub has a circumferential groove provided therein, the crease in said strap being engageable with said grove.

5. The brake apparatus according to claim 1, wherein said strap has two ends, each end having a loop formed therein and secured by a fitting, and an S-hook fitted to each loop.

6. The brake apparatus according to claim 1, wherein said polyester strap is made of PET polyester material having a relatively low coefficient of friction.

7. A brake apparatus comprising:

a rotatable bobbin having a hub, said bobbin being adapted to accommodate a supply of wire;

a brake band engageable with said hub and comprising a substantially non-porous, flat strap having a transverse dimension substantially greater than a thickness dimension and a longitudinal dimension;

a crease formed along the longitudinal dimension of said strap;

means connected to said brake band for holding said brake band engageable with said hub; and means connected to said holding means for applying a tensile force to said strap.

8. The brake apparatus according to claim 7, wherein said strap is made of a polyester material.

9. The brake apparatus according to claim 8, wherein said polyester material is polyethylene terephthalate.

10. The brake apparatus according to claim 7, wherein said crease is substantially centered along the longitudinal dimension of said strap.

11. The brake apparatus according to claim 7, wherein said strap has two ends, each end having a loop formed therein and secured by a fitting, and an S-hook fitted to each loop.

12. The brake apparatus according to claim 7, including a circumferential groove formed in said hub, said crease being engageable in said groove.

13. The brake apparatus according to claim 7, wherein said strap has a relatively low coefficient of friction.

* * * * *